United States Patent [19]

Gabler et al.

[11] Patent Number: 4,568,307

[45] Date of Patent: Feb. 4, 1986

[54] PUSH TOY VEHICLE WITH OPERABLE MOUTH

[75] Inventors: Otto L. Gabler, Redondo Bch.; Ronald L. Torres, Pico Rivera, both of Calif.

[73] Assignee: Mattel, Inc., Hawthorne, Calif.

[21] Appl. No.: 670,506

[22] Filed: Nov. 13, 1984

[51] Int. Cl.[4] ..... A63H 17/26

[52] U.S. Cl. ..... 446/448; 446/292; 446/466

[58] Field of Search ..... 446/272, 280, 287, 288, 446/292, 274, 277, 281, 282, 283, 284, 285, 286, 293, 441, 448, 449, 461, 463, 464, 466, 469, 330, 337, 338

[56] References Cited

U.S. PATENT DOCUMENTS

| | | | |
|---|---|---|---|
| 757,834 | 4/1904 | Patten et al. | 446/287 |
| 1,223,372 | 4/1917 | DiZerega | 446/292 |
| 1,497,802 | 6/1924 | Sneed | 446/281 |
| 1,649,072 | 11/1927 | McAllaster | 446/339 |
| 2,512,533 | 6/1950 | Savage | 446/272 |
| 3,017,718 | 1/1962 | Estes | 446/338 |
| 3,797,404 | 3/1974 | Barlow et al. | 446/441 |
| 4,135,328 | 1/1979 | Yamasaki | 446/463 |
| 4,216,612 | 8/1980 | Erickson et al. | 446/272 |
| 4,291,489 | 9/1981 | McCarthy, Jr. | 446/281 |
| 4,324,065 | 4/1982 | Cooper | 446/337 |

FOREIGN PATENT DOCUMENTS

| | | | |
|---|---|---|---|
| 984063 | 2/1965 | United Kingdom | 446/466 |

*Primary Examiner*—Robert A. Hafer
*Assistant Examiner*—Daniel Nolan
*Attorney, Agent, or Firm*—Ronald M. Goldman; Melvin A. Klein

[57] ABSTRACT

A push toy vehicle (10) having a rear section (14) in the shape of a half track vehicle (42) and a front section (12) with the operating jaws (22,24) of a shark or other type monster. The jaws are selectively operable by operating means (33) supported within the vehicle, upon actuation by a child pushing or applying a downward force to the rear section of the housing. The downward force rotates the rear of the housing toward the surface over which it is being moved in the forward direction, whereby the operating means is engaged to slowly open the upper jaw (24) until it reaches a release position whereby it snaps shut, in the manner of a shark or other monster.

3 Claims, 9 Drawing Figures

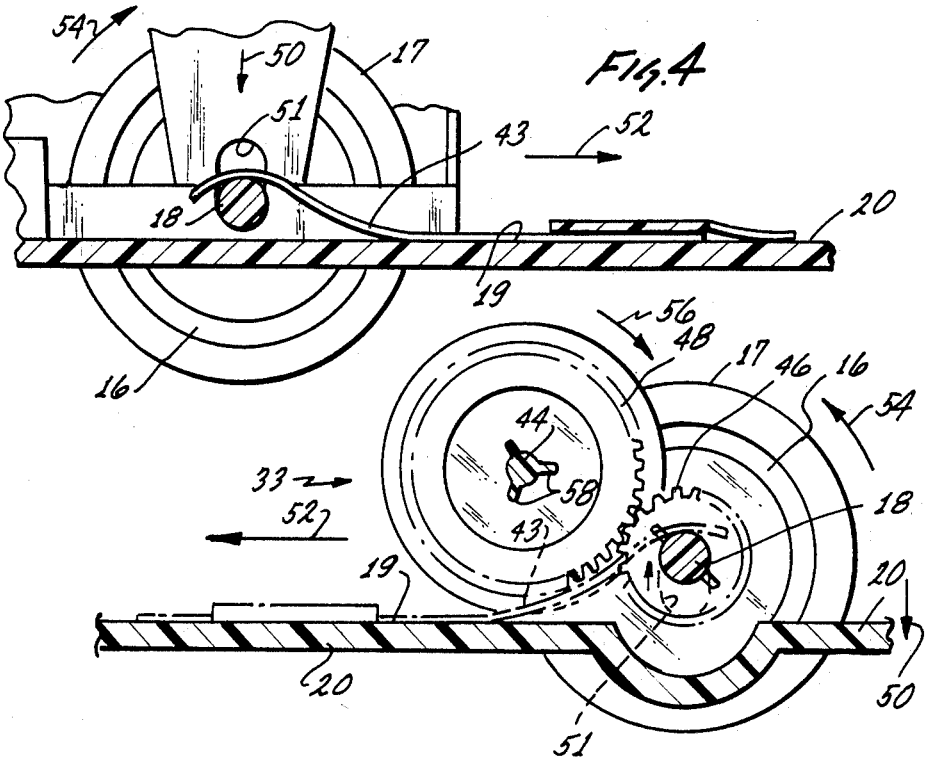
FIG. 4
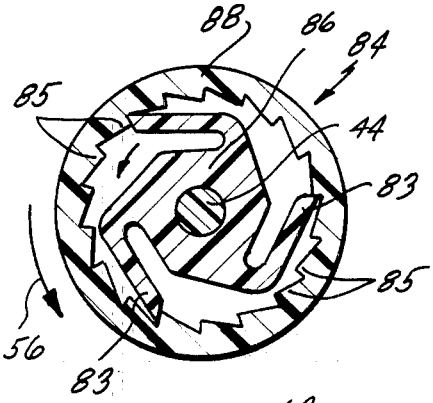
FIG. 5
FIG. 6
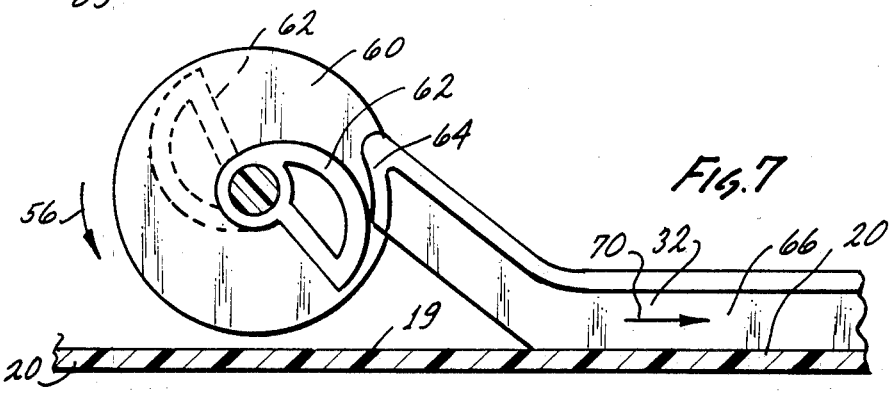
FIG. 7

10
12
14
16
18
19
20
21
22
24
26
28
32
33
34
36
38
40
42
44
60
62
64
66
68
72
74
76
78

10
12
14
16
18
19
20
21
22
24
26
28
32
33
34
36
38
40
42
44
50
54
56
60
62
64
66
68
72
74
76
78
80
82

PUSH TOY VEHICLE WITH OPERABLE MOUTH

TECHNICAL FIELD

This invention relates generally to toy vehicles and in particular to a push toy vehicle which has a selectively operated mouth.

BACKGROUND ART

Prior art toys are known in which the toys are pushed or pulled along a floor or other surface to open and close jaws held in the toys, as the toys are moved. Examples of such toys are shown in U.S. Pat. No. 757,834 issued Apr. 19, 1904; and U.S. Pat. No. 1,649,072 issued Nov. 15, 1927. In these patents, the mouth of a toy animal is operated as the toy animal is moved over a surface by either a rotating wheel having a crank connected between the wheel and the mouth, or a system of a pulleys, ropes and wire springs which expand and contract as the toy is pulled.

Other mechanical toys are known in which the mouth of the toy is operated upon actuation of a further portion of the toy, such as the tail of an alligator, as shown in U.S. Pat. No. 3,017,718 issued Jan. 23, 1962. In addition, toy games such as that shown in U.S. Pat. No. 4,324,065, disclose jaws of a toy alligator or the like into which game objects are placed. Each game object placed in the lower jaw of the alligator moves it further from a separate upper jaw until the lower jaw reaches an opened position where a latch is released to quickly close the jaws, thereby simulating the snapping jaw action of an alligator.

However, none of the known prior art discloses a push toy of the type disclosed herein in which a wheeled vehicle may be pushed across a surface and selectively either open and close the jaws of the vehicle, or merely move the vehicle in a play environment without operating the mouth.

DISCLOSURE OF THE INVENTION

The present invention provides a toy vehicle for carrying figures or the like having a plurality of wheels for movement across a floor or other surface. The front of the vehicle is provided with an operating mouth, which mouth is selectively operated only when the rear of the vehicle is pushed downwardly as the toy vehicle is simultaneously moved forwardly. An operating drive mechanism is held in a supporting structure within the vehicle, and is selectively actuated to operate the mouth whereby the mouth is slowly opened and quickly snaped shut as the vehicle traverses a surface.

DESCRIPTION OF THE DRAWINGS

The present invention may be best understood by reference to the following description, taken in conjunction with the accompanying drawings in which like reference characters refer to like elements in the several views and wherein:

FIG. 4 is a partial sectional view taken along line 4—4 of FIG. 3;

FIG. 5 is a partial sectional view taken along line 5—5 of FIG. 3;

FIG. 6 is a partial sectional view taken along line 6—6 of FIG. 3;

FIG. 7 is a partial sectional view taken along line 7—7 of FIG. 3;

BEST MODE FOR CARRYING OUT THE INVENTION

Figure 1:
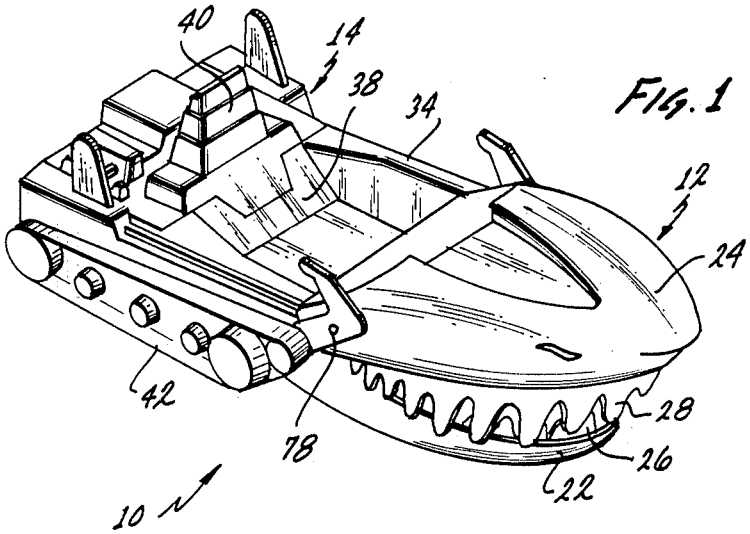
FIG. 1 is a perspective view of a preferred embodiment of the toy vehicle of the present invention.
Figure 3:
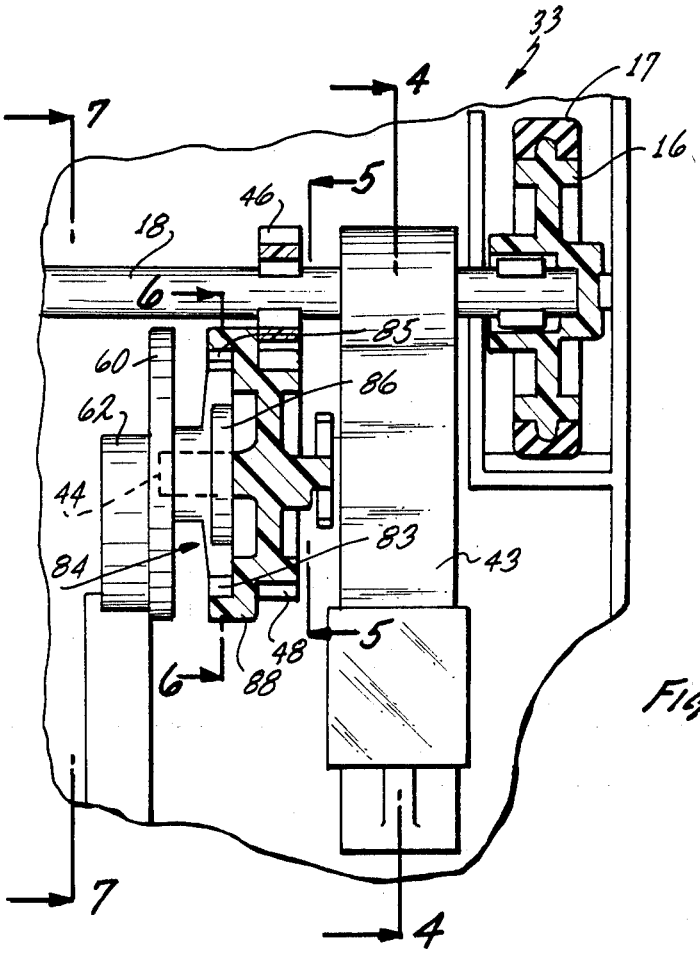
FIG. 3 is an enlarged partial top view showing the operating mechanism within the vehicle chassis for opening the mouth of the vehicle.
Figure 2:
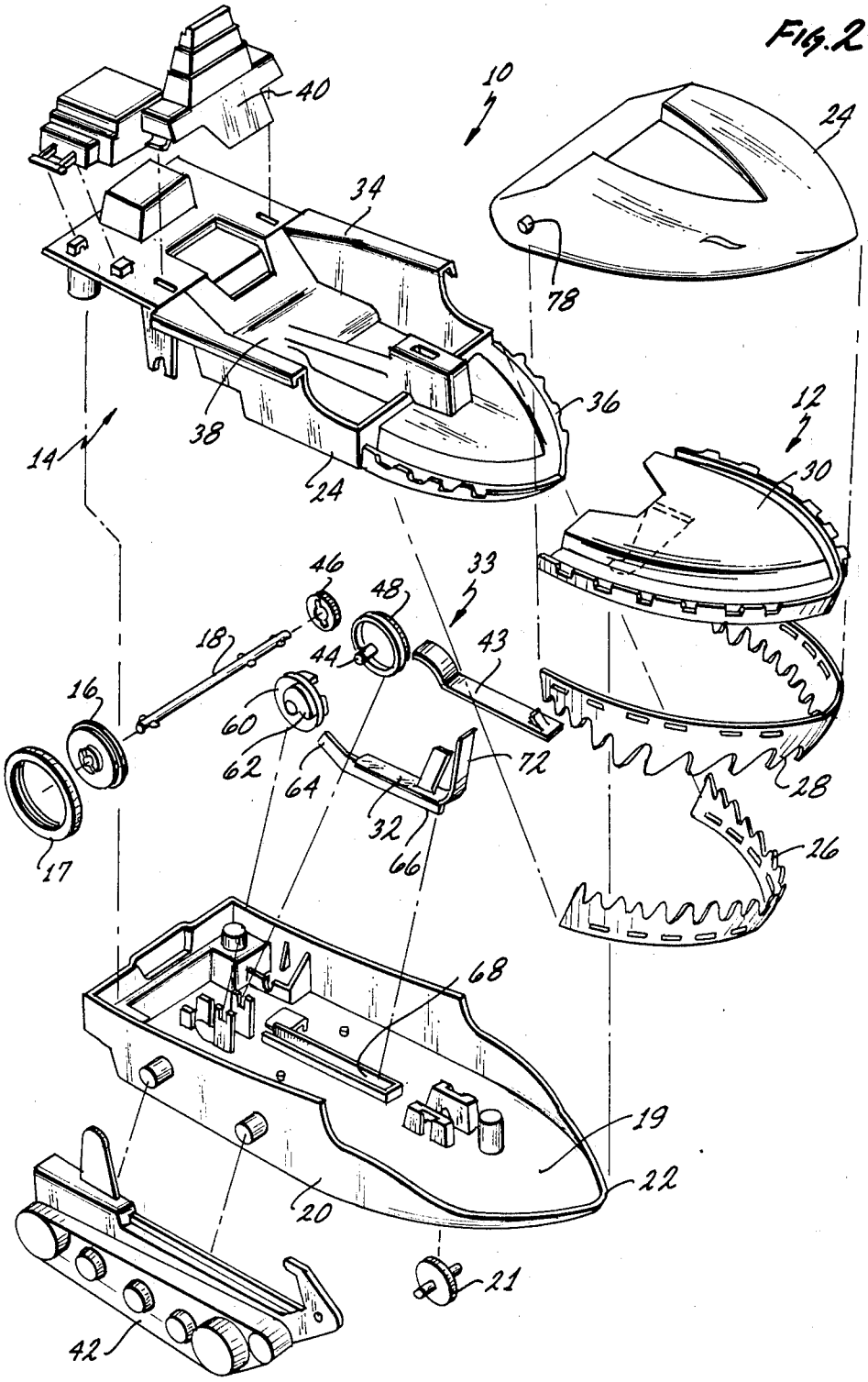
FIG. 2 is an enlarged exploded perspective view of the vehicle shown in FIG. 1.
Figure 8:
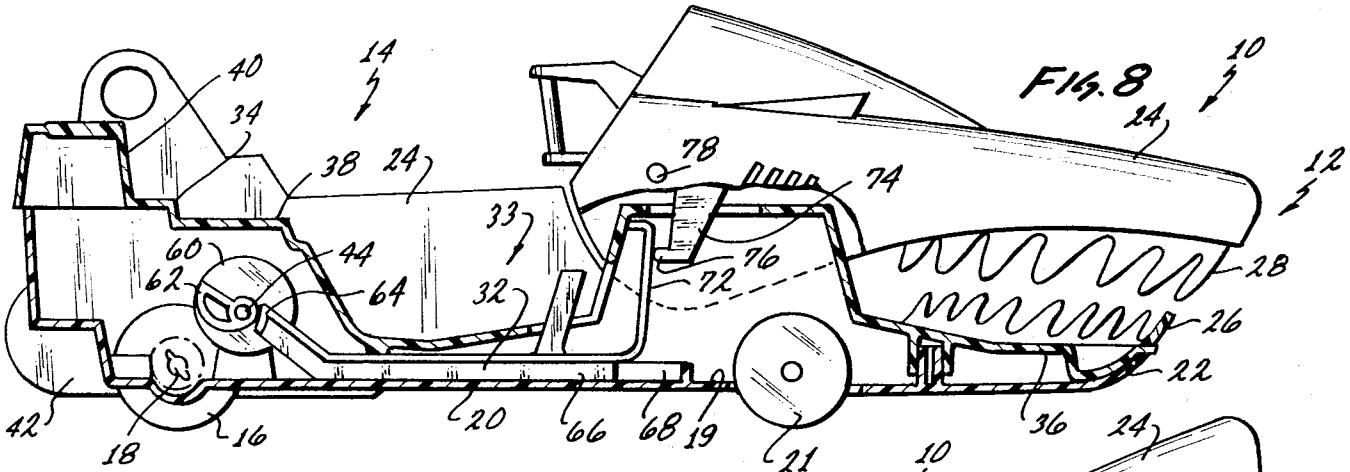
FIG. 8 is a side elevational view of the toy vehicle, partly in cross-section, with the vehicle in its normal or starting position with its rear end raised, and the mouth closed.
Figure 9:
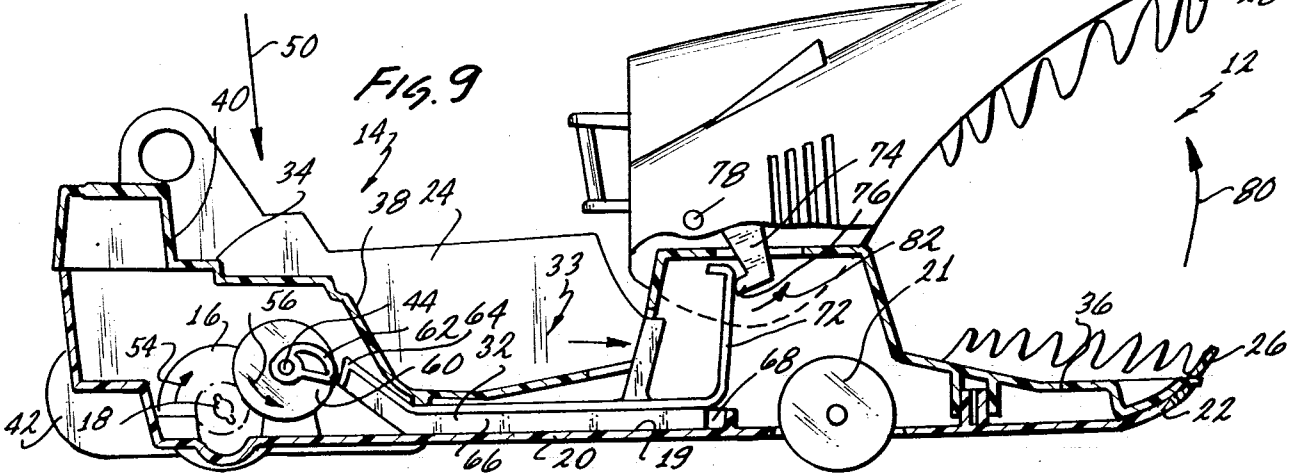
FIG. 9 is a further side elevational view, partly in cross-section, showing the vehicle with its rear end pushed downwardly, and with the mouth in the open position.

Referring now to drawings, and in particular to FIGS. 1 and 2, there shown is a vehicle 10, which, for purposes of illustration but not of limitation, is in the form of a push toy having a front section 12, and a rear section 14.

In the preferred embodiment shown, the front section 12 is in the shape of the mouth of an animal or monster, and the rear section 14 is in the form of a machine having a seat or seats therein for holding a toy figure. The vehicle includes one or more ground engaging wheels 16 mounted to the rear section, having tires 17, which allow the vehicle to be pushed along or over any desired surface. The wheels are held to or fixed on the ends of an axle 18, supported within a supporting structure or lower housing 20. Lower housing 20 supports or carrys an upper housing 34 having the front and rear sections 12, 14. A front portion 19 of the lower housing 20 glides, moves or slides over a surface on its lower surface, or by means of one or more wheels 21 held within supporting means in the lower housing.

As shown more clearly in FIGS. 1, 2, 8 and 9, the front section 12, by way of example, but not of limitation, is formed in the shape of shark's snout having a fixed lower jaw 22 and a moveable upper jaw 24. Teeth, fangs, or the like are fixed within the jaws, by arcuate strips 26, 28 fixed in upper and lower plates 30, 36, shown in FIG. 2. The upper jaw 24 is moved with respect to the lower jaw 22 by operating means 33 held within the rear of the vehicle. It being understood however, that both jaws could be made to move with respect to each other, or the lower jaw could be made to move with respect to the upper jaw. The operating means 33 coacts with a component, such as a lever or push rod arrangement 32, extending from the rear section of the vehicle into the front section thereof for contact with and movement of the upper jaw 24, as explained more fully hereinafter.

The upper housing 34 is removeably fixed to the lower structure 20 in any convenient manner. The forward section of the upper housing 34 includes the lower holding plate 36 which fits over lower jaw 22.

The rear section 14 of the vehicle is decorated or formed in any desired manner, and as shown is preferably provided with simulated half tracks 42 to give the appearance of a half track or tank-like vehicle. The wheels 16 and tires 17 may be covered by the half tracks or may be mounted on the exterior thereof, in any convenient manner.

Operation of the vehicle, and in particular the operation of the mouth will now be explained. Within the housing, at the rear section 14 of the vehicle, adjacent the rear axle 18, operating means 33 rests or is supported by the supporting structure 20. When actuated, this operating means causes the upper jaw 24 to open and then quickly snap shut, in the manner of a shark or some other type of monster. Specifically, the rear axle 18 is rotatably supported within the lower housing 20 in any convenient manner, and is maintained in position against the lower housing by spring member 43. A spur gear 46 is fixed to rear axle 18, and is selectively, operatively connected with a further driving gear 48, as shown in FIGS. 3, 5, 7 and 9, when the rear 14 of the vehicle 10 is pressed downwardly in the direction of arrow 50, toward the surface over which it is traveling. When the rear 14 of the vehicle is pressed downwardly, as by the application of a force, such as a child pressing thereon with his hand, in the direction of the arrow 50, the axle 18 is moved within slots 51 (FIGS. 4 and 5) against the bias of spring 43. The teeth of the spur gear 46 then mesh with the teeth of the driving gear 48. If, at the same time, the vehicle 10 is pushed forwardly, in the direction of arrow 52, the wheels 16 with tires 17 contacting the surface will rotate the axle 18 in the direction of arrow 54. This rotation causes spur gear 46 to rotate and at the same time to turn driving gear 48 in the direction of arrow 56 (FIG. 7). Actuation of the driving gear 48 causes the rotation of a second short axle 44 coupled thereto, and through a key or other arrangement 58 (FIG. 5), causes a disc 60 to turn. Disc 60 includes a cam 62 connected thereto or fixedly attached thereon. Therefore, the rotation of disc 60 will cause cam 62 to also rotate, in the direction of arrow 56. During rotation, a curved surface 63 of cam 62 moves into contact with one end 64 of the lever or push rod 32 and moves or slides the push rod 32 in the direction of arrow 70.

As seen more clearly in FIG. 2, the push rod 32 includes a guiding portion 66 integrally formed therewith on its bottom surface. This guiding portion 66 fits within a slot 68 formed in the lower housing 20. When the cam 62 first contacts the end 64 of the push rod 32, the push rod will be moved or slid in slot 68 by actuation of the cam. That is, the push rod 32 will slide within slot 68, in the direction of arrow 70, from its rest or starting position shown in FIG. 8, toward the outer end position shown in FIG. 9. During movement of the push rod within slot 68, an upraised outer end 72 thereof acts against the upper jaw 24, as by pressing against a finger 76 of a downwardly depending arm 74. The arm 74 is fixed to the top jaw 24 in any convenient manner. The top jaw 24 is pivotably mounted to the housing 34 in any convenient manner, as by means of outwardly extending pins 78 journaled in upwardly extending arms formed on the tracks 42. This allows the upper jaw 24 to open as it moves or rotates upwardly, from the lowered or closed position shown in FIG. 8. That is, the rotating cam 62 presses against end 64 of push rod 32 and slides outer end 72 in the direction of arrow 70. At the same time the upper jaw 24 is rotated upwardly, in the direction of arrow 80, toward the fully opened position shown in FIG. 9. During opening, the arm 74 and finger 76 move or rotate in the same direction, as indicated by arrow 82. It being understood that the push rod 32, outer end 72, depending arm 74 and finger 76 could be connected together in other arrangments to open and close the jaw 24.

As the vehicle continues to move, with the rear section pressed downwardly, the disc 60 will continue to rotate, in the direction of the arrow 56. Eventually, after the jaw 24 is fully opened, the cam 62 will rotate past the end 64, of push rod 32. In this position, the weight of the components in the open upper jaw 24 and arm 74 will be released, and will be enough to cause the upper jaw to quickly fall downwardly or snap shut. If the cam 62 is rotated still further, as discussed above, by moving the vehicle forward, with the rear 14 pushed down so as to engage gears 46, 48, the cam will again rotate into the position shown in FIG. 7. That is, the cam will again contact the end 64 of push rod 32 to thereby continuously operate the upper jaw, as explained, until the downward force on the rear section 14 is released, or the vehicle is stopped.

To insure that the jaw will only operate during travel in one direction, that is, in the forward direction as indicated by arrow 52, a one way clutch means 84 is provided between gear 48 and disc 60 (FIG. 6). This clutch only allows the disc 60 to rotate in the direction of the arrow 56. This is accomplished by means of flexible fingers 83 which only make contact with teeth 85 when turning in the desired direction. Therefore, if a child using the vehicle presses downwardly on the rear of the vehicle, and then pushes the vehicle backwards, in the direction opposite to that indicated by arrow 52, the upper jaw 24 will not open because the flexible fingers 83, formed on the interior portion 86, will move over or pass by the teeth 85, formed interiorly of the outer portion 88 thereof.

In use, the present invention provides endless play situations for a child to enjoy. The vehicle may be used as a standard vehicle having toy figures therein and may be pushed backwards or forwards across a surface on the wheels 16 and 21. Or, if to be used as an attack vehicle or the like having an opening and closing front mouth, such as the jaws of a shark, the vehicle is simultaneously pushed forwardly with its rear section pushed downwardly. In this manner, the vehicle moves forwardly over a surface, while at the same time the jaws open slowly and then come crashing down or snap shut. This movement of the jaws can be engaged or disengaged at will by a child who merely presses down on or releases the rear section of the vehicle during forward movement thereof. In addition, if desired the child user may manually open and close the jaw 24 by grasping the upstanding portion of push rod 32 and moving it within the housing, without moving the vehicle 10.

While the particular vehicle shown and described in detail herein is fully capable of attaining the objects and providing the advantages above stated, it is to be understood that it is merely illustrative of the presently preferred embodiment of the invention. No limitations are intended in the details of the contruction or design shown, other than as defined in the attached claims, which form a part of this disclosure.

The term "means", as employed in the claims is to be interpreted as defining the corresponding structure illustrated and described in the specification or the equivalent thereof.

We claim:

1. In a push toy vehicle, the combination comprising:

a supporting structure;

a housing having front and rear sections mounted over and supported by said supporting structure;

said front section of said housing including upper and lower jaws, with the upper jaw being journaled to said housing for relative movement to an opened position above and away from said lower jaw;

said rear section taking the form of a vehicle with a plurality of wheels mounted on an axle held therein, to allow movement of said vehicle over a surface;

operating means mounted within said vehicle in the rear section thereof, between said housing and said supporting structure, and capable of being operated by means mounted to said axle upon application of a downward force to said rear section, whereby driving means held on said rear axle is operatively connected with a gear means mounted within said rear section; said operating means including a cam operated by said gear means;

a sliding push rod member having front and rear ends held within said supporting structure for constrainted movement backwards and forwards between said rear wheels and a forward wheel, said push rod member operated by said cam means upon rotation of said cam means; the front end of said push rod member including an elevated section coupled to said upper jaw member, whereby upon actuation of said push rod by said cam means acting against said rear end thereof, said upper jaw will be moved relative to said lower jaw, to the opened position away from said support structure; and said push rod being quickly returned to its starting position adjacent said rear wheels by the release of said downward force against said rear section, or by the action of the weight of said upper jaw and the means coupling said upper jaw to the forward upwardly extending portion of said push rod, after said cam by-passes the front end of said push rod member.

2. The push toy vehicle of claim 1 wherein said upper jaw will only move to the opened position upon simultaneous forward movement of said vehicle with said downward force applied to said rear section.

3. The push toy vehicle of claim 1 wherein said push rod may be manually actuated, by the operation of an upwardly extending portion fixed thereto, to operate said upper portion of said jaw.

* * * * *